United States Patent [19]

Favron

[11] 4,428,273

[45] Jan. 31, 1984

[54] AUTOMATIC CHORDER FOR STRINGED INSTRUMENTS

[76] Inventor: Emile H. Favron, 116 Mountain St., Sudbury, Ontario, Canada, P3B 2R2

[21] Appl. No.: 340,871

[22] Filed: Jan. 19, 1982

[30] Foreign Application Priority Data

Jan. 27, 1981 [CA] Canada ..... 369433

[51] Int. Cl.[3] ..... G10D 3/08

[52] U.S. Cl. ..... 84/317

[58] Field of Search ..... 84/315–317, 84/319

[56] References Cited

U.S. PATENT DOCUMENTS

| | | |
|---|---|---|
| 1,094,038 | 4/1914 | Weaver et al. . |
| 1,427,026 | 11/1922 | Spartivento . |
| 1,553,057 | 9/1925 | Weaver . |
| 1,692,560 | 11/1928 | Mokrejs . |
| 2,669,151 | 2/1954 | MacCaferri . |
| 2,746,337 | 5/1956 | Smit . |
| 2,790,344 | 4/1957 | Brimhall . |
| 2,798,398 | 7/1957 | Hayes . |
| 3,129,626 | 4/1964 | Granius . |
| 3,422,717 | 1/1969 | Roussel . |
| 3,446,108 | 5/1969 | Mitchell, Jr. . |
| 3,568,560 | 3/1971 | Chang et al. . |
| 3,776,088 | 12/1973 | Jones . |
| 3,805,664 | 4/1974 | Starns . |
| 3,903,776 | 9/1975 | Owen . |
| 3,995,523 | 12/1976 | Clarke . |
| 4,154,134 | 5/1979 | Schreiber . |

FOREIGN PATENT DOCUMENTS

| | | |
|---|---|---|
| 78374 | 9/1897 | Canada . |

*Primary Examiner*—Lawrence R. Franklin

*Attorney, Agent, or Firm*—Robbins & Laramie

[57] ABSTRACT

An apparatus to facilitate playing of a stringed musical instrument such as a guitar, banjo or the like especially when used for chording. The apparatus is adapted to be mounted on a musical instrument. It contains a small number of moving parts, the levers, and is, therefore, easy to maintain and to manufacture, and allows even beginners to play the instrument with ease.

26 Claims, 16 Drawing Figures

AUTOMATIC CHORDER FOR STRINGED INSTRUMENTS

This invention relates to an apparatus to facilitate playing of a stringed instrument such as a guitar, banjo or the like, especially when used for chording, and to a stringed instrument in combination with such an apparatus.

Several chording devices have been proposed containing levers for depressing groups of strings to form chords. Most of the known devices. However, require very complicated mechanisms and are, consequently, difficult to maintain and expensive to manufacture. Other known mechanical fingering devices have to be moved from one position to another and require readjustment during playing in order to produce the desired chords. This is often difficult to accomplish without interruption of the playing.

Representative of known devices of this type are those described in U.S. Pat. Nos. 1,094,038, 3,568,560 and 3,995,523.

The present invention seeks to overcome these and other disadvantages of the known devices.

It is an object of the invention to provide an apparatus in combination with a stringed musical instrument which facilitates playing of the instrument, especially when used for chording.

It is a further object of the invention to provide an apparatus which allows even beginners to play a stringed musical instrument with ease.

It is another object of the invention to provide an apparatus which has few moving parts and is, therefore, easy to maintain and to manufacture.

Further objects and advantages of the invention will become apparent from the following description and claims and from the accompanying drawings.

In one aspect of the present invention there is provided an apparatus to facilitate playing of a stringed musical instrument such as a guitar, banjo or the like including a head, a neck having frets spaced longitudinally therealong and a plurality of strings, preferably at least seven strings, spaced laterally thereacross. Adjacent strings are spaced an equal distance from each other and are tuned to have a difference in pitch of four half-tones. The apparatus according to the invention comprises:

(a) Frame means which are mountable on the neck of the musical instrument. Preferably the frame means includes a hand rest to facilitate pressing down of the levers into the lower position.

(b) A plurality of levers which are pivotally mounted to the frame means and which, when the apparatus is mounted on the neck of the stringed musical instrument, extend transversely over the neck and strings of the musical instrument. Each of the levers has a plurality of string contacting means. Each string contacting means is engageable with at least one of the strings. The levers are independently moveable between an upper position in which the string contacting means are out of engagement with the strings and a lower position in which the string contacting means engage selected strings corresponding to the fingering of a selected chord. Preferably, each lever is mounted such that when the lever is held in the lower position the string contacting means depress the strings in close proximity to one of the frets.

(c) Means for releasably securing to the frame one of the levers in the lower position.

(d) Means for biasing the levers out of engagement with the strings.

The frame means includes sliding means for lateral shifting of the levers between different lateral positions. Two consecutive lateral positions have a distance equal to the distance between two adjacent strings.

In a preferred embodiment of the invention the apparatus includes a first, a second and a third lever disposed generally parallel to each other, such that, when said apparatus is attached to said musical instrument, the first lever is mounted closest to the head of the musical instrument, and is releasably secured to the frame in the lower position so as to provide, when the instrument is plucked, a first preselected chord without fingering. The second lever and the third lever are each adapted to be manually pressed down into a lower position so as to provide when the instrument is plucked a second and a third chord of a chord family. Optionally the apparatus includes a fourth lever with one string contacting means engageable with a high pitch string close to a fifth fret so as to produce a high pitch tone. Advantageously the second and the third chord are based on the subdominant and dominant, respectively, of the first chord. The sliding means allows the first, second and third lever to be shifted together between a first, a second and a third lateral position, such that when the instrument is plucked, each lever provides a different chord in each lateral position, whereby the first, second and third chords in one lateral position belong to one chord family. The string contacting means of the first lever are arranged parallel to a first fret, the string contacting means of the second lever are arranged parallel to a second fret adjacent to the first fret, and the string contacting means of the third lever are arranged parallel to a third fret adjacent to the second fret and parallel to a fourth fret adjacent to the third fret.

Preferably, the apparatus comprises at least one auxiliary lever, each of the auxiliary levers having at least one string contacting means engageable with at least one of the strings. More preferably, the apparatus comprises a first and a second auxiliary lever. The first auxiliary lever is pivotally mounted on the frame between the second and third lever and generally parallel thereto. It has one string contacting means located close to the second fret and is activated in conjunction with the second lever to complete the second chord and in conjunction with the third lever to produce the seventh tone to the third chord. An extension is mounted on the third lever to effect activation of the first auxiliary lever simultaneous with pressing down of the third lever. The second auxiliary lever is pivotally mounted on the third lever and has one string contacting means located close to the fourth fret. The second auxiliary lever when activated completes the third chord while eliminating the seventh tone produced by the first auxiliary lever.

In another aspect of the invention there is provided a stringed musical instrument such as a guitar, banjo and the like in combination with an apparatus for facilitating playing of said instrument comprising:

(a) a head;

(b) a neck having frets spaced longitudinally therealong and a plurality of strings spaced laterally thereacross, adjacent strings being spaced an equal distance from each other and being tuned to have an equal difference in pitch, advantageously the difference in pitch is four half-tones;

(c) a body;

(d) frame means mounted on the neck;

(e) a plurality of levers pivotally mounted to the frame means and extending transversely over the neck and the strings, each of the levers having a plurality of string contacting means, each string contacting means being engageable with at least one of the strings; the levers being independently moveable between an upper position in which the string contacting means are out of engagement with the strings and a lower position in which the string contacting means engage selected strings corresponding to the fingering of a selected chord;

(f) means for releasably securing to the frame one of the levers in the lower position; and (g) means for biasing the levers out of engagement with said strings;

the frame means including sliding means for lateral shifting of the levers between different lateral position, two consecutive lateral positions having a distance equal to the distance between two adjacent strings.

The present invention provides a chording apparatus mounted on a stringed musical instrument. The strings of the instrument are equidistantly spaced and are tuned such that any two adjacent strings have the same difference in pitch. In a preferred embodiment this difference in pitch is four half-tones. The chorder is secured to the neck of the instrument and comprises a housing, a frame including a bar to which a number of levers are hingedly connected and which generally extend parallel to one side of the neck, a handrest extending generally parallel to the other side of the neck, and one or more rods passing through the neck perpendicular to the strings, thus connecting the bar with the handrest and securing the chording apparatus to the instrument.

The levers extend across the neck parallel to the frets of the instrument. Each lever has a top surface facing the housing and a bottom surface facing the strings. On the bottom surface of each lever one or more string contacting means or pads are provided. The levers are spring biased in an upper position away from the strings. When a lever is pressed down against the strings, i.e. pushed into the lower position, each pad may engage one or more strings. All the pads are arranged such that they press on the strings in close proximity to one of the frets along the neck.

The lever next to the head of the musical instrument, lever 1, can be releasably locked to the frame in the lower position. In this locked position the pads of lever 1 engage several strings just above a first fret, thereby providing, when the instrument is plucked, the basic chord of the open strings. In the embodiment of the invention which is most suitable for beginning players four or five additional levers are provided. Lever 2 which is located parallel to and adjacent to lever 1 extends partially over the handrest. The pads on lever 2 engage, when the lever is pressed into the lower position, several strings just above a second fret so as to provide, when the instrument is plucked, a chord of the same chord family as the basic chord provided by lever 1.

Auxiliary lever 1, a small lever adjacent lever 2, has only one pad which engages a string just above the second fret. This auxiliary lever extends only partially across the neck of the instrument. Parallel to levers 2 and auxiliary lever 1 is a wide lever 3 which, like lever 2, extends partially across the handrest. It carries pads which, when the lever is pressed down into the lower position, engage strings just above a third and a fourth fret so as to provide, when the instrument is plucked, a third chord of the chord family of the basic chord. Auxiliary lever 1 is activated whenever either lever 2 or lever 3 is pressed down. To effect this lever 3 is provided with an extension which causes auxiliary lever 1 to be depressed simultaneously with lever 3. When activated in conjunction with lever 2, auxiliary lever 1 simply completes the chord formed by lever 2. When activated in conjunction with lever 3, auxiliary lever 1 provides a tone which is two half-tones lower than the key tone of the chord provided by lever 3, i.e. auxiliary lever 1 provides the seventh tone in the key of the chord produced by pressing down lever 3. For example, when the instrument is tuned such that pressing down of lever 3 results in a G major chord, auxiliary lever 1 provides the tone of F.

A small auxiliary lever 2 is mounted either on lever 3 or directly beside it extending approximately as far as the handrest. It carries one pad which, when pressed down, engages the same string as auxiliary lever 1, but two frets further down, i.e. just above the fourth fret, forming a tone which is two half-tones higher than the tone provided by auxiliary lever 1. When lever 3 is activated together with auxiliary lever 2, the latter completes the chord formed by lever 3, thus eliminating the 7th tone provided by auxiliary lever 1.

Chording apparatus according to the invention which are designed for more advanced players are supplied with additional levers.

In order to be able to play chords or tunes in a different key and chord family, the levers or the pads thereon can be moved into different lateral positions, whereby the distance between two lateral positions is equal to the distance between two strings.

In embodiments in which the pads are directly secured to the levers, the whole chorder is moved laterally relative to the neck by slidingly moving the rod or rods back and forth through the neck. An alternative way of moving the pads laterally is by securing the pads of each lever to a slide which, in turn, can be moved along the respective lever. In this case the chorder is not moved as a whole, only the slide on each lever is moved.

Advantageously, three lateral positions are provided. To change from one lateral position to another lever 1 has to be released. Locking down lever 1 in the adjacent position will produce a new basic chord. The interval between the basic chord in one position and the basic chord in the neighbouring lateral position is equal to the interval between two strings. The same is valid for all corresponding chords.

Optionally, an additional lever can be mounted directly to the neck adjacent to the chorder. This lever advantageously has one pad which, when the lever is pressed down, engages the string with the highest pitch just above a fifth fret. The lever allows the player who picks a tune and wants to produce a tone above the tones which can be produced by using the chorder to more easily reach the high pitch string in close proximity to the chorder. Thus, this lever extends the range of the instrument.

The use of more than the standard six strings improves the sound of the instrument partly because two or three strings are tuned to the same note, with a difference in pitch of one or two octaves, thus causing increased resonance.

The housing of the chorder is preferably made of wood. The part of the housing which may come into contact with the levers when these are released quickly can be padded with materials such as felt so as to minimize any noise. The outside of the frame of the chorder can be made of materials such as wood or plastic. The rods can be round, square or any similar shape in cross-section and may be manufactured of chrome-or nickel-plated steel or the like. For round rods made of solid steel the preferred diameter lies between about ¼ to 5/16 inch. The levers may be made of materials such as wood, plastic or metal and the pads may be manufactured of materials such as wood or hard rubber.

The present invention may more readily be understood by reference to the accompanying drawings which illustrate by way of example several embodiments of the invention and in which FIG. 1 is a general perspective view of a stringed musical instrument having a chording apparatus according to the invention attached to the neck thereof;

Figure 3:
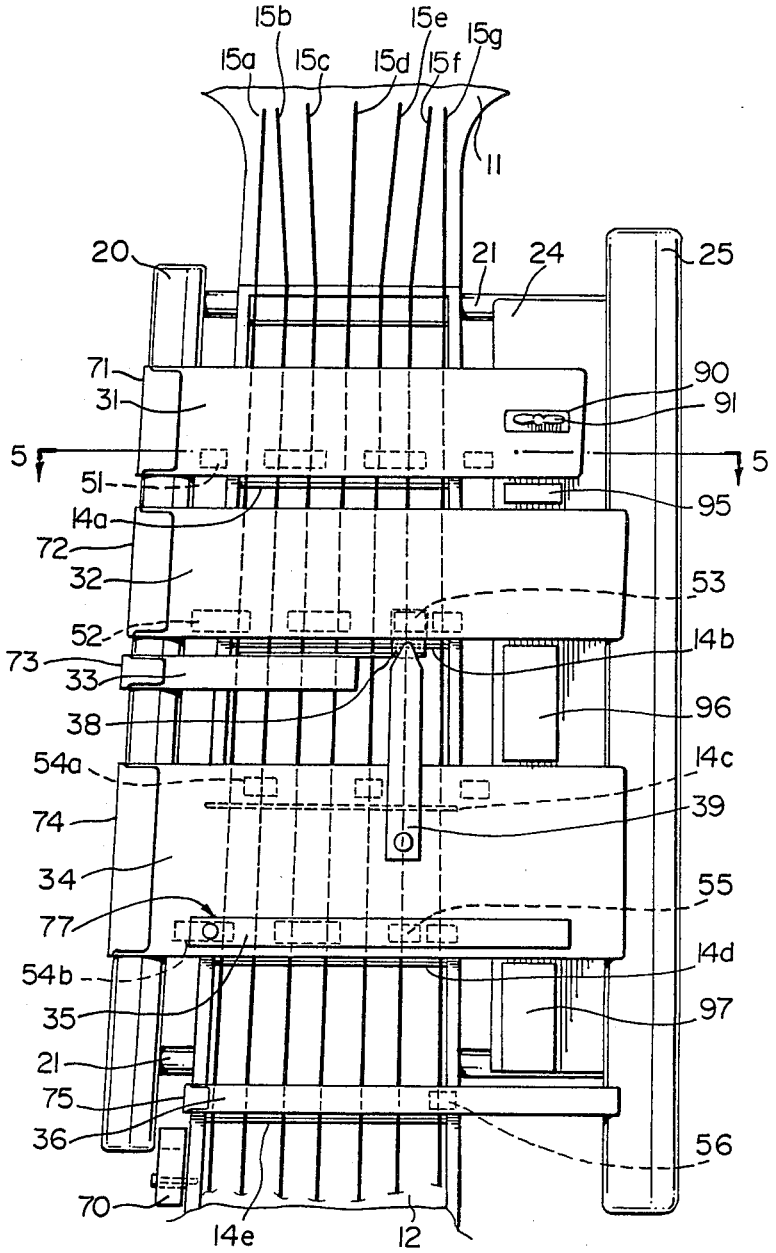
FIG. 3 is a diagrammatic plan view of the embodiment of FIG. 2.
Figure 6:
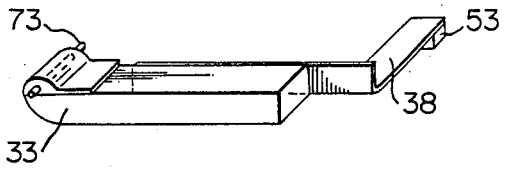
Figure 7:
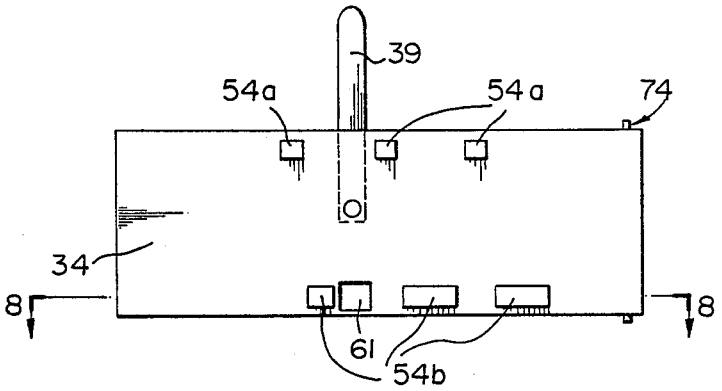
Figure 8:
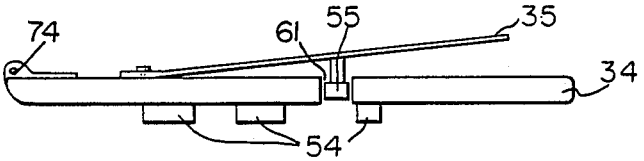

FIGS. 5 A to C are schematic cross-sectional views taken along line 5—5 in FIG. 3 showing the chorder in position 1, 2 and 3, respectively;

FIG. 6 is a perspective view of auxiliary lever;

FIG. 7 is a bottom view of lever 3;

FIG. 8 is a cross-sectional view of lever 3 taken along line 8—8 in FIG. 7; and

FIGS. 9 to 11 are diagrams illustrating the position of pads of all the levers, except for the optional sixth lever, relative to the strings in various lateral positions.

Figure 1:
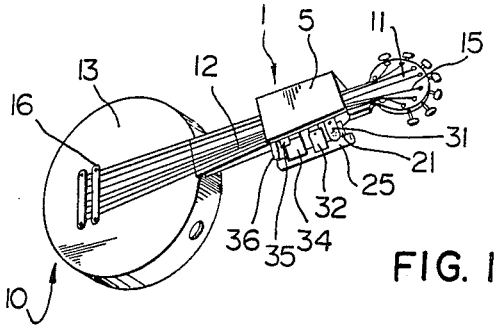
Figure 2:
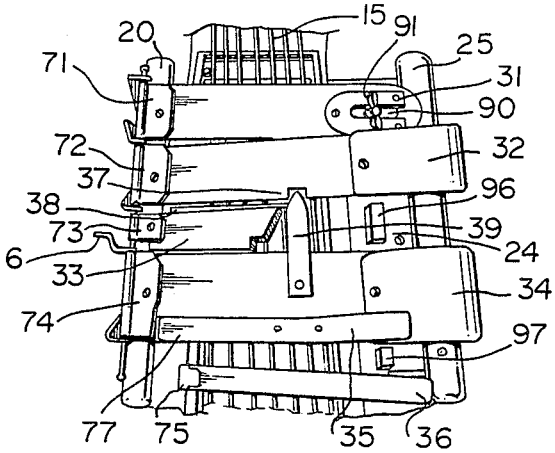
FIG. 2 is a perspective view of an embodiment of the chorder with six levers and with the housing removed, the chorder being attached to the neck of a stringed instrument.
Figure 4:
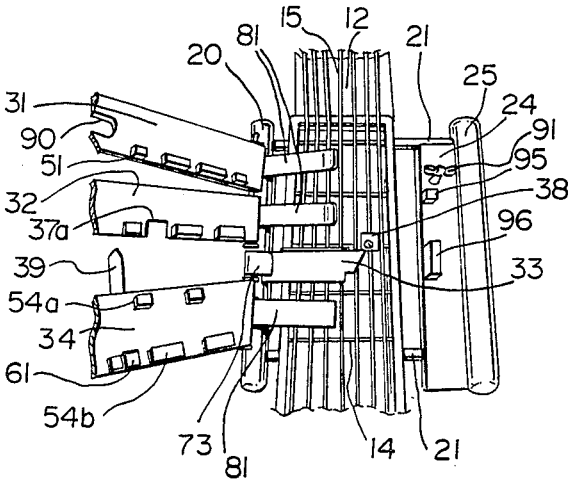
FIG. 4 is a perspective view of a second embodiment of the chorder attached to the neck of a stringed instrument with five levers, four of which are in a wide open position.

Referring to the drawings, FIG. 1 shows a stringed instrument 10 having a head 11, a neck 12, a body 13 with a bridge 16, and equidistantly spaced strings 15*a–g*. To neck 12 a chording apparatus 1 is attached. This chorder comprises a housing 5, levers 31 to 35 and a frame. Referring to FIGS. 2 to 4, the frame includes on one side of the neck 12 a handrest 25, having an extension 24 and on the other side of neck 12 a bar 20 to which levers 31 to 34 are connected by way of hinges 71 to 74 and to which means 6 for fastening the housing 5 are fixed. Frame parts 20, 24 and 25 extend parallel to neck 12. They are connected by two parallel rods 21 which pass through the neck 12 of the stringed instrument perpendicular to the strings, thus securing the chorder 1 on the instrument 10.

Levers 31 to 36 extend across neck 12 parallel to frets 14*a–e* of the instrument. Levers 31 to 34 are hinged to bar 20. Lever 35 is fastened to lever 34 and lever 36 may, optionally, be connected directly to the neck by way of hinge 75. Levers 31, 32, 34 and 36 are spring biased away from the strings in an upper position (shown in phantom in FIG. 5B) by leaf springs 81.

On the bottom surface of each lever facing strings 15 one or more pads 51 to 56 are located. These pads may engage one or more strings 15 when the respective lever is pressed down into the lower position.

Between levers 31 and 32, levers 32 and 34 and levers 34 and 36 guides 95, 96 and 97 are arranged. These guides are fixed to extension 24.

Figure 5A:
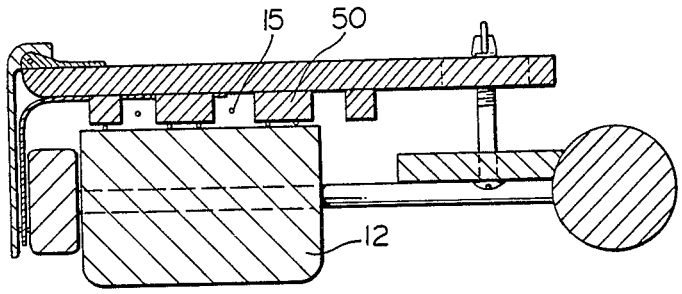

The chorder can be shifted transversely to the neck of the instrument into three different lateral positions. In FIGS. 5A, B and C positions 1, 2 and 3, respectively, are shown. In position 1, bar 20 is directly adjacent to neck 12. In position 2 the neck is in the centre between bar 20 and extension 24 and in position 3 extension 24 is adjacent to the neck. In order to facilitate positioning of the chorder in position 2 a stop 70 may optionally be provided (FIGS. 3 and 4). This stop is slideably secured to neck 12. The distance between positions 1 and 2 and between positions 2 and 3 is equal to the distance between two strings.

Figure 5B:
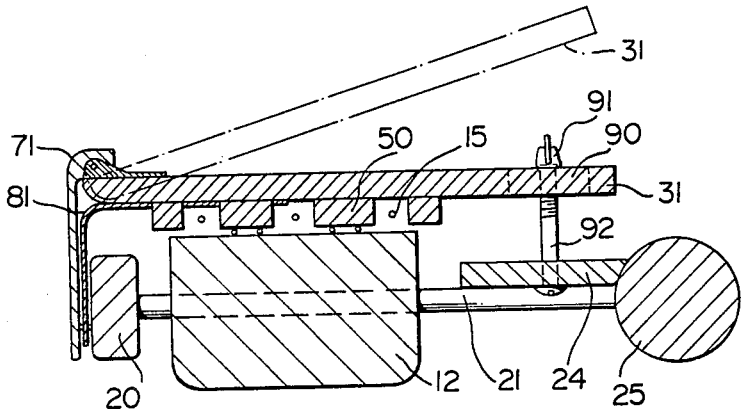
Figure 5C:
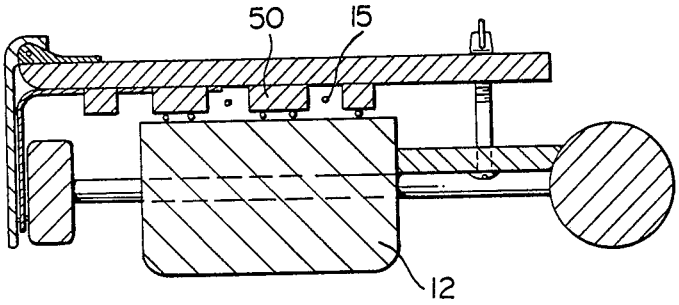

Lever 31 ends on extension 24, whereas levers 32 and 34 and lever 36 extend partially across handrest 25. Lever 31 has an opening 90 in the part of the lever extending over extension 24. This opening operates with a wing nut 91 and bolt 92 which are fixed to extension 24. With this wing nut lever 31 can be locked into the lower position as shown in FIGS. 5A to C. Four pads 51 are secured to lever 31, two single pads, each capable of engaging one string, and two double pads, each capable of engaging two strings. The pads engage the respective strings directly above fret 14*a*.

On lever 32 three pads 52, two double and one single pad, are located such that they can engage the respective strings directly above fret 14*b*. Lever 33 (shown in FIG. 6) is narrower than levers 31 and 32 and extends only partially across the strings directly adjacent and parallel to lever 32. The tip 38 of lever 33 is arranged approximately perpendicular to the rest of lever 33 and reaches under lever 32. Tip 38 carries a single pad 53 which is capable of engaging the string next to the single pad on lever 32. Lever 32 may be provided with a recess 37 (FIG. 2) or a partially recessed area 37*a* (FIG. 4) in order to facilitate cooperation of tip 38 with lever 32.

Lever 34 (shown in FIGS. 7 and 8) is wider than the other levers and has two sets of pads 54*a* and 54*b* which are spaced apart approximately the distance between two consecutive frets. The three single pads 54*a* are capable of engaging the respective strings directly above fret 14*c*. The two double and one single pads 54*b* can engage the respective strings just above the fret 14*d*. Next to the single pad of set 54*b* is an opening 61 in lever 34. On the top side of lever 34 above pads 54*b* a small lever 35 is provided. (FIG. 8). This lever is fastened to lever 34 such as to be spring biased away from lever 34 in the area above opening 61. A single pad 55 is mounted to lever 35 such that it fits through opening 61 and is, thus, capable of engaging the string next to the single pad of set 54*b*. Also fixed to the top side of lever 34 is a small stiff extension 39 (FIG. 7) which connects lever 34 with lever 33.

Lever 36 which may optionally be hinged to the neck is provided with one single pad 56 which, when pressed down, engages the string with the highest pitch directly above fret 14*e*.

To prepare the stringed instrument for playing housing 5 is opened, wing nut 91 is loosened and the strings are tuned so that two neighbouring strings are four half-tones apart. For example, the strings can be tuned to the following notes G, B, D♯, G, B, D♯ etc. or F♯, A♯, D, F♯, A♯, D, etc. The chorder 1 is shifted into the desired lateral position and lever 31 is fixed in the lower position with wing nut 91 so that pads 51 engage the respective strings. Following this, housing 5 is closed and the instrument is ready for playing. When the instrument is plucked without any fingering, the chosen basic chord is produced. When a change of chord is desired, the player simply presses lever 32 or lever 34.

Actuating levers 32 and 34 is greatly facilitated by the following three aspects of the present invention. Firstly, both these levers are wide, between ¾ and 1½ inch, and therefore easy to find. Secondly, both these levers extend beyond the neck of the instrument which increases the leverage and, thus, makes it very easy for the player to press down the strings when playing the instrument. Thirdly, the player's hand rests against handrest 25 from below and his or her fingers can therefore press the levers with very little effort towards the handrest.

When lever 32 is pressed down, pads 52 engage the respective strings. Additionally, lever 32 automatically activates lever 33 via tip 38, thus causing pad 53 to engage the respective string. Levers 32 and 33 together produce, when held in the lower position, the chord based on the subdominant of the basic chord, i.e. a chord five half-tones higher. When lever 34 is pressed down lever 33 is again automatically activated via extension 39, thus causing pads 54 as well as pad 53 to engage the respective strings. When held in the lower position levers 34 and 33 together produce the dominant seventh chord. When the chord based on the dominant of the basic chord, i.e. the chord seven half-tones higher than the basic chord, is desired, lever 35 is pressed together with lever 34. As pad 55 engages the same string as pad 53, the pressing down of lever 35 eliminates the effect of lever 33.

If for accompaniment of another tune a different key and chord family is desired, lever 31 is released and shifted into a different lateral position. As two neighbouring strings are tuned four half-tones apart, shifting the chorder to the adjacent lateral position will produce chords which are four half-tones lower or four half-tones higher than the three correschords in the original position.

The stringed instrument shown in FIGS. 9 to 11 has seven strings, 15*a* to 15*g*, which are tuned to the following notes starting with the lowest pitch: G, B, D♯, G, B, D♯ and G, each string having a difference in pitch of four half-tones from the adjacent string or strings. FIGS. 9, 10 and 11 show the chords which can be produced when the chorder is in lateral position 1, 2 or 3, respectively, and the instrument is plucked.

Figure 10A:
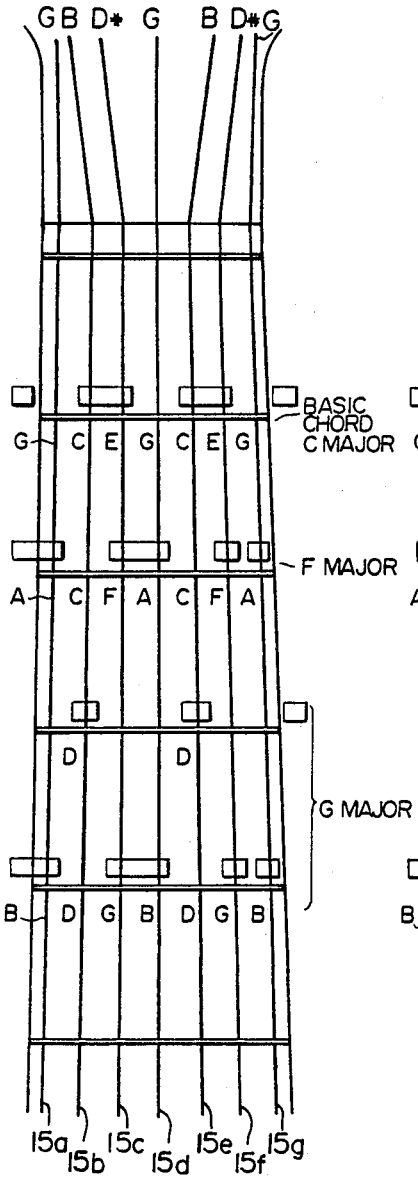

Referring to FIGS. 10A and B, the basic chord produced when the chorder is in lateral position 2 and lever 31 is locked into the lower position is C major. Pressing down of lever 32, which automatically causes lever 33 to be pressed down, results in a chord five half-tones higher, the F major chord. Pressing down of lever 34, which also automatically activates lever 33, produces the G seventh chord shown in FIG. 10B, and pressing down of lever 34 and 35 simultaneously results in a chord seven half-tones higher than the basic chord illustrated in FIG. 10A.

Figure 9A:
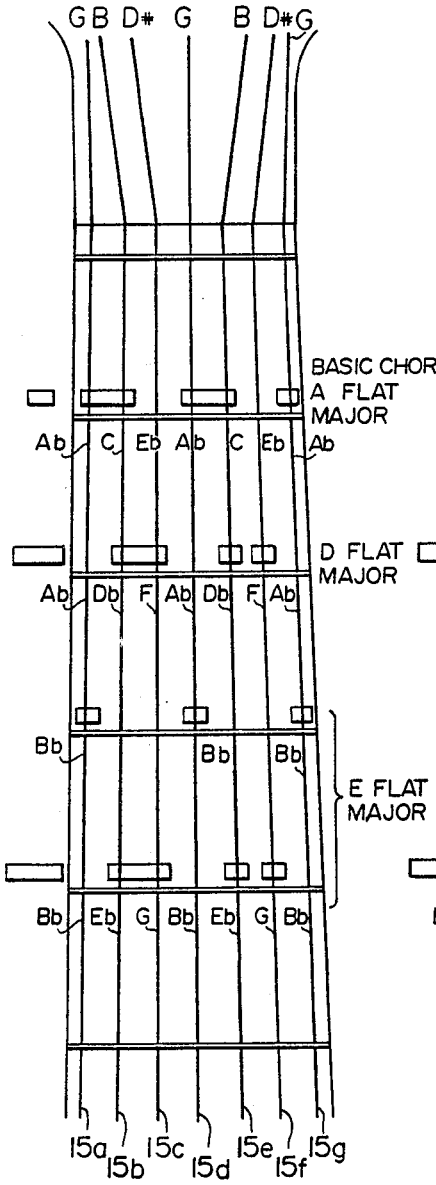
Figure 9B:
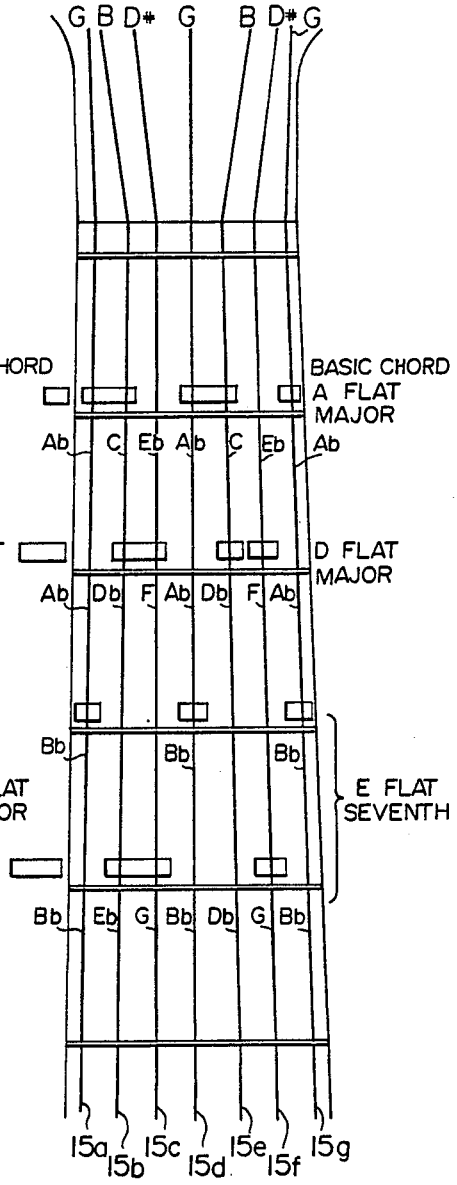
Figure 10B:
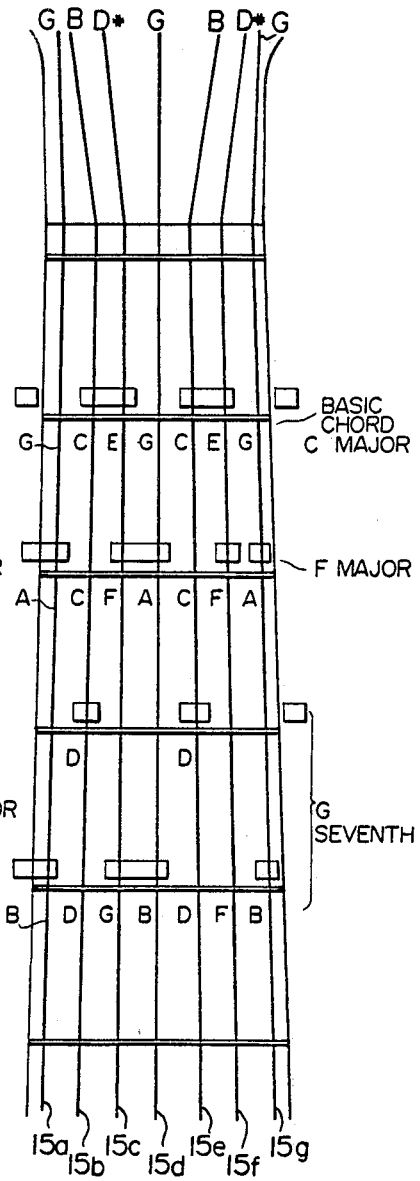

Similarly, in lateral position 1 illustrated in FIG. 9, the basic chord produced by lever 31 is A flat major which is four half-tones lower in pitch than the basic chord in lateral position 2. Pressing of lever 32 produces the D flat major chord, of lever 34 the E flat seventh chord shown in FIG. 9B, and of levers 34 and 35 together the E flat major chord illustrated in FIG. 9A.

Figure 11A:
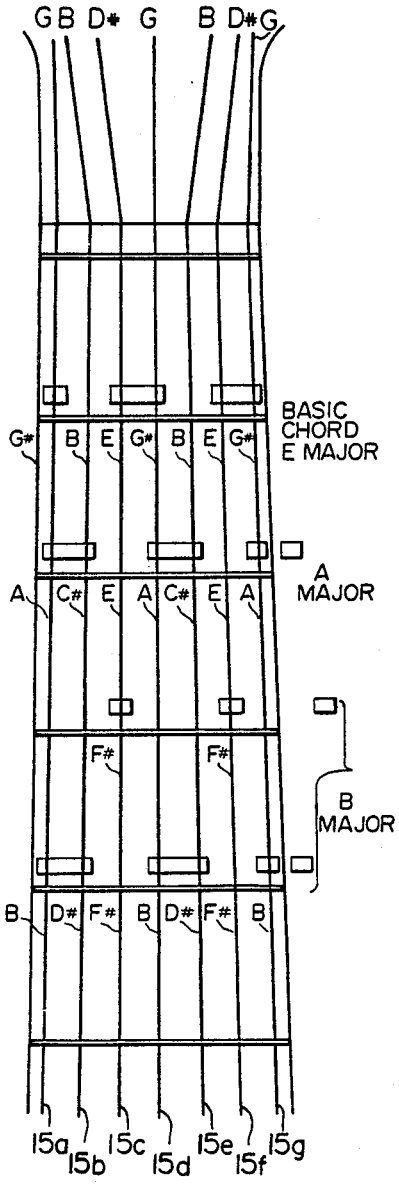
Figure 11B:
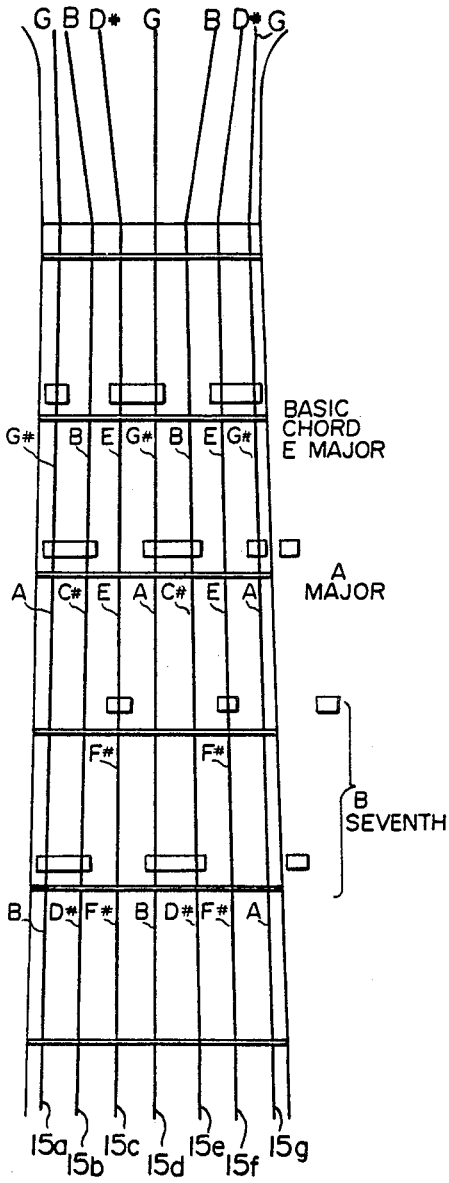

In lateral position 3 illustrated in FIG. 11 the basic chord produced by lever 31 is E major, which is four half-tones higher in pitch than the basic chord in lateral position 2. Pressing of lever 32 produces the A major chord, of lever 34 the B seventh chord shown in FIG. 11B, and of levers 34 and 35 simultaneously the B major chord shown in FIG. 11A.

If a player wants to play a tune rather than chords, he or she can pick individual strings and by alternately using the open strings or pressing either lever 32 or lever 34, the player can produce tones over a range of more than two octaves. Use of lever 36 can further extend this range.

The spacing between the strings at the bridge 16 of the instrument is preferably quite wide, advantageously between ⅝ to ¾ inch. The increased space between strings facilitates picking, in particular, for the beginner.

From the foregoing description it can be seen that the chording apparatus according to the invention has a minimum of moving parts and that pressing down of a lever by a player directly engages the strings. This simplicity of design allows for easy operation and very little maintenance.

In particular, the embodiment of the chording apparatus designed for beginners allows people without any or with very little experience in playing a stringed instrument to play a banjo, guitar or the like to which this chorder is mounted. All that is required of the player is tuning of the strings such that the difference in pitch is four half-tones, choosing the lateral position with the most appropriate pitch, and locking the lever 31 in place. By simply plucking the open strings the player gets the basic chord and by alternately pressing lever 32 and lever 34 (with or without lever 35) he or she can accompany most tunes adequately. As the chords produced in any one lateral position belong to one chord family, even a beginner cannot play really off key.

From the foregoing description further modifications and embodiments will be apparent to those skilled in the art. The embodiments disclosed are intended only to illustrate the invention without limiting the scope thereof.

The embodiments of the invention in which an exclusive property or privilege is claimed are defined as follows:

1. Apparatus to facilitate playing of a stringed musical instrument such as a guitar, banjo, or the like including a head, a neck having frets spaced longitudinally therealong and a plurality of strings spaced laterally thereacross, adjacent strings being spaced an equal distance from each other and being tuned to have a difference in pitch of four half-tones, said apparatus comprising:

(a) frame means mountable on said neck;

(b) a plurality of levers pivotally mounted to said frame means and, when mounted on the neck of said stringed musical instrument, extending transversely over the neck and strings of the musical instrument; each of said levers having a plurality of string contacting means, each string contacting means being engageable with at least one of the strings; said levers being independently moveable between an upper position in which the string contacting means are out of engagement with the strings and a lower position in which the string contacting means engage selected strings corresponding to the fingering of a selected chord;

(c) means for releasably securing to the frame one of the levers in the lower position; and (d) means for biasing the levers out of engagement with said strings;

said frame means including sliding means for lateral shifting of the levers between different lateral positions, two consecutive lateral positions having a distance equal to the distance between two adjacent strings.

2. The apparatus of claim 1 including a first, a second and a third lever disposed generally parallel to each other, such that, when said apparatus is attached to said musical instrument, the first lever is mounted closest to the head of the musical instrument, said first lever being releasably secured to the frame in the lower position so as to provide, when the instrument is plucked, a first preselected chord without fingering, and said second lever and said third lever each being adapted to be manually pressed down into a lower position so as to provide, when the instrument is plucked, a second and a third chord of a chord family.

3. The apparatus of claim 2 wherein said second and said third chord are based on the subdominant and dominant, respectively, of said first chord.

4. The apparatus of claim 3 wherein the sliding means allows the first, second and third lever to be shifted together between a first, a second and a third lateral position, such that, when the instrument is plucked, each lever provides a different chord in each lateral position, the first, second and third chords in one lateral position belonging to one chord family.

5. The apparatus of claim 1 wherein each lever is mounted such that when the lever is held in the lower position the string contacting means depress the strings in close proximity to one of the frets.

6. The apparatus of claim 4 wherein the string contacting means of the first lever are arranged parallel to a first fret, the string contacting means of the second lever are arranged parallel to a second fret adjacent to the first fret, and the string contacting means of the third lever are arranged parallel to a third fret adjacent to the second fret and parallel to a fourth fret adjacent to the third fret.

7. The apparatus of claim 6 further comprising at least one auxiliary lever, each of the auxiliary levers having at least one string contacting means engageable with at least one of the strings.

8. The apparatus of claim 7 further comprising a first auxiliary lever pivotally mounted on the frame between the second and third lever and generally parallel thereto, said first auxiliary lever having one string contacting means located close to the second fret and being activated in conjunction with the second lever to complete the second chord and in conjunction with the third lever to produce the seventh tone to the third chord.

9. The apparatus of claim 8 further comprising a second auxiliary lever pivotally mounted on the third lever and having one string contacting means located close to the fourth fret, said second auxiliary lever when activated completing the third chord while eliminating the seventh tone produced by the first auxiliary lever.

10. The apparatus of claim 9 wherein an extension is mounted on the third lever to effect activation of the first auxiliary lever simultaneous with pressing down of the third lever.

11. The apparatus of claim 6 which includes a fourth lever with one string contacting means engageable with a high pitch string close to a fifth fret so as to produce a high pitch tone.

12. The apparatus of claim 1, 10 or 11 wherein said frame means includes a hand rest to facilitate pressing down of the levers into the lower position.

13. The apparatus of claim 1, 10 or 11 wherein the stringed musical instrument is provided with at least seven strings.

14. A stringed musical instrument such as a guitar, banjo and the like in combination with an apparatus for facilitating playing of said instrument comprising:

(a) a head;

(b) a neck having frets spaced longitudinally therealong and a plurality of strings spaced laterally thereacross, adjacent strings being spaced an equal distance from each other and being tuned to have an equal difference in pitch;

(c) a body;

(d) frame means mounted on said neck;

(e) a plurality of levers pivotally mounted to said frame means and extending transversely over the neck and the strings, each of said levers having a plurality of string contacting means, each string contacting means being engageable with at least one of the strings; said levers being independently moveable between an upper position in which the string contacting means are out of engagement with the strings and a lower position in which the string contacting means engage selected strings corresponding to the fingering of a selected chord;

(f) means for releasably securing to the frame one of the levers in the lower position; and (g) means for biasing the levers out of engagement with said strings;

said frame means including sliding means for lateral shifting of the levers between different lateral position, two consecutive lateral positions having a distance equal to the distance between two adjacent strings.

15. The combination of claim 14 wherein two adjacent strings are tuned to have a difference in pitch of four half-tones.

16. The combination of claim 15 wherein a first, a second and a third lever are disposed generally parallel to each other, said first lever being mounted closest to the head and being releaseably secured to the frame in the lower position so as to provide when the instrument is plucked a first preselected chord without fingering, and said second lever and said third lever each being adapted to be manually pressed down into a lower position so as to provide when the instrument is plucked, a second and a third chord of a chord family, said second and said third chord being based on the subdominant and dominant, respectively, of said first chord.

17. The combination of claim 16 wherein the sliding means allows the first, second and third lever to be shifted together between a first, a second and a third lateral position, such that, when the instrument is plucked, each lever provides a different chord in each lateral position, whereby the first, second and third chords in one lateral position belong to one chord family.

18. The combination of claim 14, 15 or 17 wherein each lever is mounted such that when the lever is held in the lower position the string contacting means depress the strings in close proximity to one of the frets.

19. The combination of claim 17 wherein the string contacting means of the first lever are arranged parallel to a first fret, the string contacting means of the second lever are arranged parallel to a second fret adjacent to the first fret, and the string contacting means of the third lever are arranged parallel to a third fret adjacent to the second fret and parallel to a fourth fret adjacent to the third fret.

20. The combination of claim 19 further comprising at least one auxiliary lever, each of the auxiliary levers having at least one string contacting means engageable with at least one of the strings.

21. The combination of claim 20 further comprising a first auxiliary lever pivotally mounted on the frame between the second and third lever and generally parallel thereto, said first auxiliary lever having one string contacting means located close to the second fret and being activated in conjunction with the second lever to complete the second chord and in conjunction with the third lever to produce the seventh tone to the third chord.

22. The combination of claim 21 further comprising a second auxiliary lever pivotally mounted on a third lever and having one string contacting means located close to the fourth fret, said second auxiliary level when activated completing the third chord while eliminating the seventh tone produced by the first auxiliary lever.

23. The combination of claim 21 wherein an extension is mounted on the third lever to effect activation of the first auxiliary lever simultaneous with pressing down of the third lever.

24. The combination of claim 19 which includes a fourth lever with one string contacting means engagable with a high pitch string close to a fifth fret so as to produce a high pitch tone.

25. The combination of claim 14, 15 or 23 wherein said frame means includes a hand rest to facilitate pressing down of the levers into the lower position.

26. The combination of claim 14, 15 or 23 wherein at least seven strings are spaced laterally across the neck.

* * * * *